US006099665A

United States Patent [19]

Teraoka et al.

[11] Patent Number: 6,099,665

[45] Date of Patent: Aug. 8, 2000

[54] METHOD FOR PRODUCING CR-NI TYPE STAINLESS STEEL THIN SHEET HAVING EXCELLENT SURFACE QUALITY

[75] Inventors: Shin-ichi Teraoka; Toshiyuki Suehiro; Eiichiro Ishimaru, all of Hikari; Tetsurou Takeshita, Kitakyushu; Shunji Shoda, Futtsu; Takashi Arai; Hideki Oka, both of Hikari; Yoshikatsu Nohara, Futtsu, all of Japan

[73] Assignee: Nippon Steel Corporation, Tokyo, Japan

[21] Appl. No.: 08/728,881

[22] Filed: Oct. 10, 1996

[51] Int. Cl.[7] ..... C21D 1/09

[52] U.S. Cl. ..... 148/542; 148/601; 148/602; 148/603; 164/476; 164/477

[58] Field of Search ..... 148/542, 601, 148/602, 603, 608; 164/476, 477

[56] References Cited

FOREIGN PATENT DOCUMENTS 63-421 1/1988 Japan .
2-133528 5/1990 Japan .
402133528 5/1990 Japan .
403039421 2/1991 Japan .
405070834 3/1993 Japan .

*Primary Examiner*—Sikyin Ip
*Attorney, Agent, or Firm*—Kenyon & Kenyon

[57] ABSTRACT

This invention aims at producing a cold rolled thin sheet having excellent surface quality from a cast strip of a Cr—Ni type stainless steel cast strip by a thin casting method. The production method of the invention comprises the steps of continuously casting a Cr—Ni type stainless steel to a cast strip having a thickness of not greater than 10 mm by using a continuous casting machine the cast mold wall surface of which moves in synchronism with the cast strip; hot rolling the resulting cast strip at a temperature within the range of 900 to 1,200° C. at a reduction ratio of 10 to 50%; carrying out, subsequently, heat-treatment at a temperature within the range of 1,200 to 900° C. for at least 5 seconds; coiling the hot rolled cast strip at a temperature not higher than 600° C.; descaling the rolled cast strip; cold rolling the cast strip; conducting annealing, pickling or bright annealing; and conducting skin pass rolling, whenever necessary.

5 Claims, 2 Drawing Sheets

METHOD FOR PRODUCING CR-NI TYPE STAINLESS STEEL THIN SHEET HAVING EXCELLENT SURFACE QUALITY

BACKGROUND OF THE INVENTION

1. Field of the Invention

In a process for casting a Cr—Ni type stainless steel to a cast strip having a sheet thickness of not greater than 10 mm and cold rolling the cast strip to a thin sheet product, the present invention relates to a method for producing a Cr—Ni type stainless thin sheet having an excellent surface quality.

2. Description of the Related Art

Recently, a technology for directly obtaining a cast strip having a sheet thickness of not greater than 10 mm from a molten steel by casting has been developed, and experiments on an actual production scale have been carried out. According to this new technology, a hot rolling step can be simplified or omitted.

Slabs having a thickness greater than 100 mm have been hot rolled in the past in a hot rolling mill which uses enormous quantities of energy. If the hot rolling step can be simplified or omitted, it not only reduces the production cost but is also preferable from the aspect of protecting the environment. Hereinafter, a process including the step of producing a cast strip having a sheet thickness of not greater than 10 mm from a molten steel will be referred to as the "new process", and a process including a step of hot rolling a slab to a cast strip will be referred to as the "existing process".

Conventionally, when a Cr—Ni type stainless steel cold rolled strip typified by an 10% Cr–8% Ni steel is produced by the new process, skin coarsening (called "orange peel" or "roping") occurs on the surface of the product.

According to an article described in the transactions of the Japan Iron and Steel Association, entitled "Materials and Processes" (CAMP-ISIJ), Vol. 1 (1990), p. 770, the surface quality of a SUS304 thin sheet produced by the new process becomes deteriorated. This article reports than skin coarsening (roping) similar to orange peel occurs on the surface of the cold rolled sheet due to coarse crystal grains appearing in the material before finish cold rolling. The article describes further that in order to prevent this problem, the following two measures for refining the crystal grains of the material before finish cold rolling are effective:

1) To apply hot rolling and annealing to a cast strip. For example, hot rolling is conducted at a reduction ratio of 16% at 1,200° C., and solution heat treatment is conducted at 1,150° C. for 1 minute.

2) To apply cold rolling twice with intermediate annealing to the cast strip. For example cold rolling is conducted to a reduction ratio of 10% at a room temperature and, after intermediate annealing, finish rolling is than carried out.

On the other hand, an article of "Materials and Processes" (CAMP-ISIJ), Vol. 4 (1991), p. 996, describes that surface skin coarsening (roping) of a cold rolled sheet can be improved by applying skin pass rolling to a high reduction ratio, but because mechanical properties of the sheet, particularly elongation, drop, components must be adjusted so as to attain gamma-phase unstable components, that is, to attain a high Md 30. The article describes further that when Md 30 is 30° C. and skin pass rolling is conducted to a reduction ratio of 1%, roping and mechanical properties (elongation) can be improved compared to those of the sheets produced by the existing process.

Another article in "Materials and Processes" (CAMP-ISIJ), Vol. 4 (1991), p. 997, describes that surface skin coarsening (roping) of the cold rolled sheet can be improved by a chemical component design which increases the delta-ferrite quantity and makes the gamma-phase unstable.

Japanese Unexamined Patent Publication (Kokai) No. 63-421 describes that a thin sheet having a small anisotrophy and excellent corrosion resistance can be produced by hot rolling a cast strip having a sheet thickness of not greater than 10 mm at a temperature not lower than 800° C. to not higher than 50% reduction and then coiling the rolled sheet at a temperature not higher than 650° C. However, this prior art technology is directed to prevent the drop of anisotrophy due to hot rolling and for this reason, it restricts the hot rolling reduction ratio to not higher than 50% and conducts hot rolling for shaping. It is therefore believed that the thin sheet produced by this prior art technology is not free from the occurrence of roping.

Japanese Unexamined Patent Publication (Kokai) No. 2-133528 describes that when hot rolling is conducted at a temperature not lower than 900° C. to a reduction ratio of not higher than 60%, the structure of the cast strip is recrystallized and roping can be improved. This prior art reference describes that roping can be improved irrespective of annealing after hot rolling, but describes only that cooling is carried out at a cooling rate of at least 50° C./sec within the range of temperature of 900 to 550° C. as a thermal hysteresis of the cast strip after hot rolling.

The inventors of the present invention have experimentally conducted the production of the Cr—Ni type stainless steel thin sheet by employing the technology of Japanese Unexamined Patent Publication (Kokai) No. 2-133528 described above, but have failed to improve the surface quality. It has thus been clarified that a complete recrystallization structure cannot be obtained by merely conducting hot rolling under the conditions of a temperature of not higher than 900° C. and a reduction ratio of not higher than 60%.

SUMMARY OF THE INVENTION

When the known technologies described above are applied so as to produce the Cr—Ni type stainless steel sheet having excellent surface quality by the new process, various problems occur from the aspect of productivity, setup, stabilization of product quality, and so forth. For example:

① When the cast strip is subjected to hot rolling and solution heat-treatment, the solution heat-treatment step becomes additionally necessary.

② When the slab is cold rolling twice with intermediate annealing, the two procedures for cold rolling-annealing are required.

③ When a skin pass rolling reduction ratio is increased, the mechanical properties (elongation) drop.

④ When chemical component is controlled, the kinds of steel that can be produced are limited.

⑤ Even when hot rolling is carried out at least 900° C. with a reduction ratio of not higher than 60%, the surface quality cannot be stably obtained.

The present invention is directed to solve the problem of surface quality, which is encountered when the Cr—Ni type stainless steel thin sheet is produced by the new process, without lowering productivity in comparison with the existing process.

To accomplish the object described above, the present invention employs the following construction.

In other words, the production method according to the present invention comprises the steps of continuously casting a molten steel of a Cr—Ni type stainless steel to a cast strip having a sheet thickness of not greater than 10 mm, preferably greater than 2 mm to not greater than 10 mm, by using a continuous casting machine, the casting mold wall surface of which moves in synchronism with the cast strip, subsequently hot rolling the thin strip slab at a temperature within the range of 900 to 1,200° C. at a reduction ratio of 20 to 50%, conducting heat-treatment by holding the slab at a temperature within the range of 900 to 1,200° C. for at least 5 seconds, coiling the rolled sheet at a temperature not higher than 600° C., descaling the steel strip, cold rolling it and effecting annealing, pickling or bright annealing. Skin pass rolling is carried out, after the steps described above, whenever necessary.

When cooling is conducted to the coiling temperature after the heat-treatment described above, cooling is preferably done at a cooling rate of at least 20° C./sec within the range of 900 to 600° C. The rolling temperature is preferably within the range of 1,150 to 1,000° C., and the heat-treatment temperature after rolling is preferably within the range of 1,150 to 1,050° C.

DESCRIPTION OF THE PREFERRED EMBODIMENTS

Figure 1:
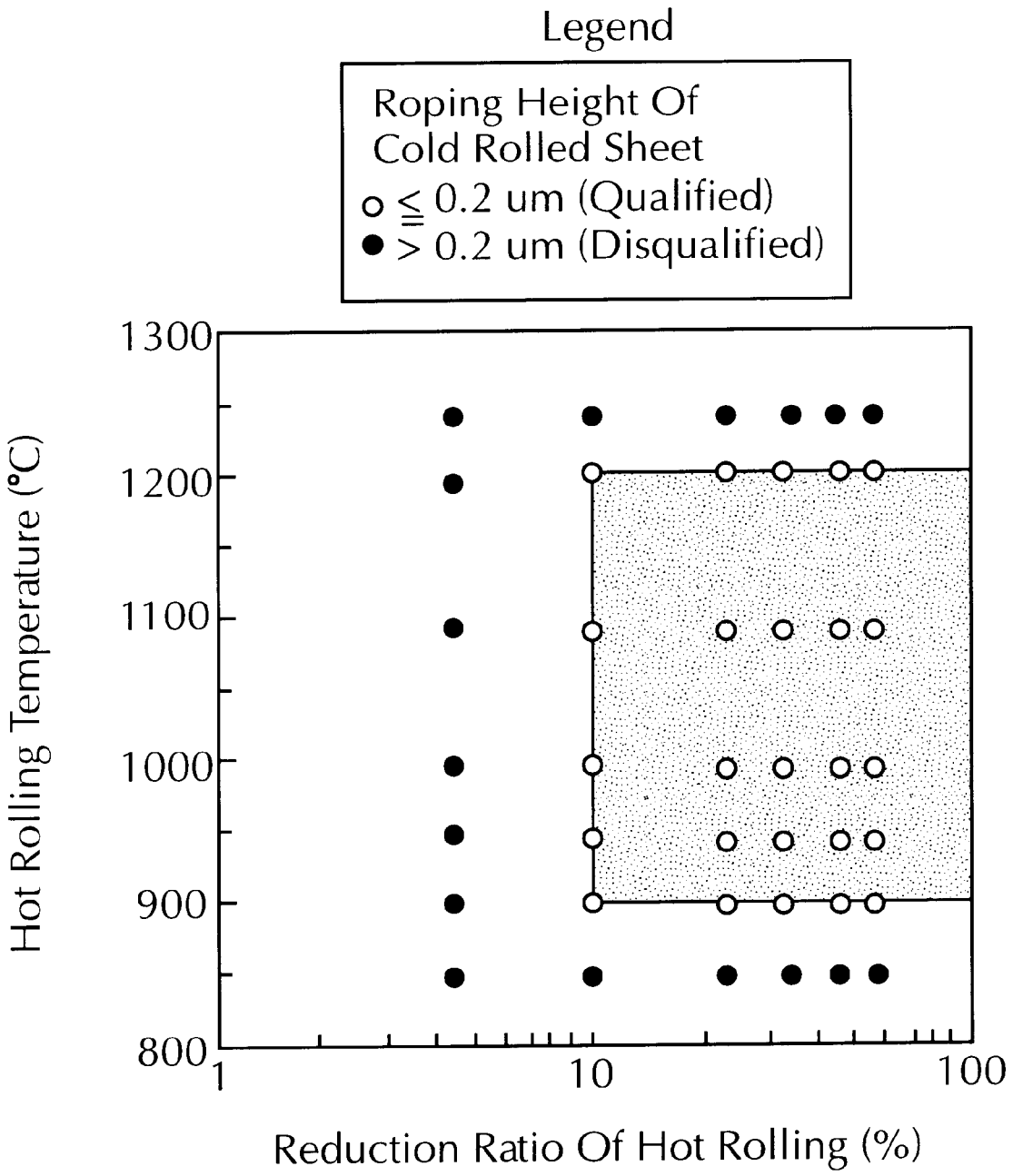
FIG. 1 is a diagram showing the relationship between a hot rolling temperature and a reduction ratio for a thin slab versus a roping height on a cold-rolled product.

In order to finely pulverize crystal grains in a cast strip, it is most efficient to conduct hot rolling by a hot rolling mill directly coupled to a casting machine. However, it is not efficient to cool a rolled sheet to room temperature and then to conduct a solution heat-treatment, as described in the afore-mentioned prior art references. It is therefore preferred to conduct hot rolling by a hot rolling mill directly coupled with a casting machine, then to conduct heat-treatment so as to cause sufficient recrystallization, to coil a rolled sheet at a low temperature to carry out solution heat-treatment.

The inventors of the present invention have examined methods of obtaining a sufficient recrystallized structure in a process for a hot rolled sheet which omits annealing, and have clarified that a sufficient recrystallized structure can be obtained by carrying out heat-treatment immediately after hot rolling. This heat-treatment is characterized in that heat-treatment necessary for recrystallization is carried out without lowering the cast strip temperature immediately after rolling to or below 800° C.

In this new process, the cast strip heating step before hot rolling, that has been carried out in the existing process, is completely omitted. Further, because the sheet thickness is thin, a cooling rate after solidification is by far higher than that of a slab. In consequence, precipitates such as MnS, $Cu_2S$, etc., which otherwise precipitate in the existing continuous cast slabs, is held in solid solution in a slab. If hot rolling is carried out under this state and the rolled sheet is cooled below 800° C. without allowing sufficient recrystallization, fine precipitates precipitate along the dislocation introduced by hot rolling and, in order to obtain a complete recrystallization structure in subsequent annealing of the hot rolled sheet, a longer heat-treatment time is necessary compared to the heat-treatment carried out immediately after hot rolling. To recrystallize efficiently the hot rolled sheet structure, therefore, it is effective to carry out the heat-treatment immediately after hot rolling, without lowering the cast strip temperature below 800° C., to obtain a complete recrystallization structure.

Next, the reasons for the limitation of the constitution requirements of the present invention will be explained.

The present invention uses Cr—Ni type stainless steels typified by an 18% Cr–8% Ni steel as the kind of the steel. Since phase transformation occurs twice after solidification in ordinary carbon steels, the problem of roping due to coarsening of the structure does not occur in comparison with the Cr—Ni type stainless steel.

When the thickness of the cast strip exceeds 10 mm, on the other hand, the crystal grains at the time of solidification become coarse and, in order to finely pulverize the crystal grains by hot rolling recrystallization, a high reduction ratio becomes necessary. To attain this object, a plurality of hot rolling mills must be installed or an extremely large hot rolling mill must be employed, so that the economical effect of the invention is lost. A preferred range of the cast strip thickness is 3 to 5 mm.

The hot rolling temperature and the reduction ratio were determined by the following experiment. A type 304 steel was casted to a 4 mm-thick cast strip in a laboratory, and hot rolling with a reduction ratio of 5 to 50% was carried at a temperature within the range of 1,250 to 900° C. to obtain a hot rolled steel strip. The strip was then passed through a heat-treating furnace kept at 1,000° C. for 5 seconds, was then cooled secondarily and was coiled at a temperature not higher than 600° C. After descaling, the cast strip was cold rolled at a reduction ratio of 50%, and roping of the surface of the cold rolled sheet was evaluated. The result is shown in FIG. 1.

When the hot rolling temperature was higher than 1,200° C., roping could not be improved because the recrystallized grains became coarse. When the hot rolling temperature was less than 900° C., recrystallization did not proceed due to precipitation of MnS and $Cu_2S$ during hot rolling. When the hot rolling reduction ration was lower than 10%, a complete recrystallization structure could not be obtained, and roping occurred. From the result described above, hot rolling was carried out at a temperature within the range of 900 to 1,200° C. and at a reduction ratio of not greater than 10%. In order to carry out hot rolling at a reduction ratio higher than 50% for the cast strip, a plurality of huge hot rolling mills had to be used, and the features of the new process could not be exploited. Therefore, the hot rolling reduction ratio was set to not higher than 50%. The preferred range was a reduction ratio of 10 to 30% and the hot rolling temperature of 1,000 to 1,150° C.

Figure 2:
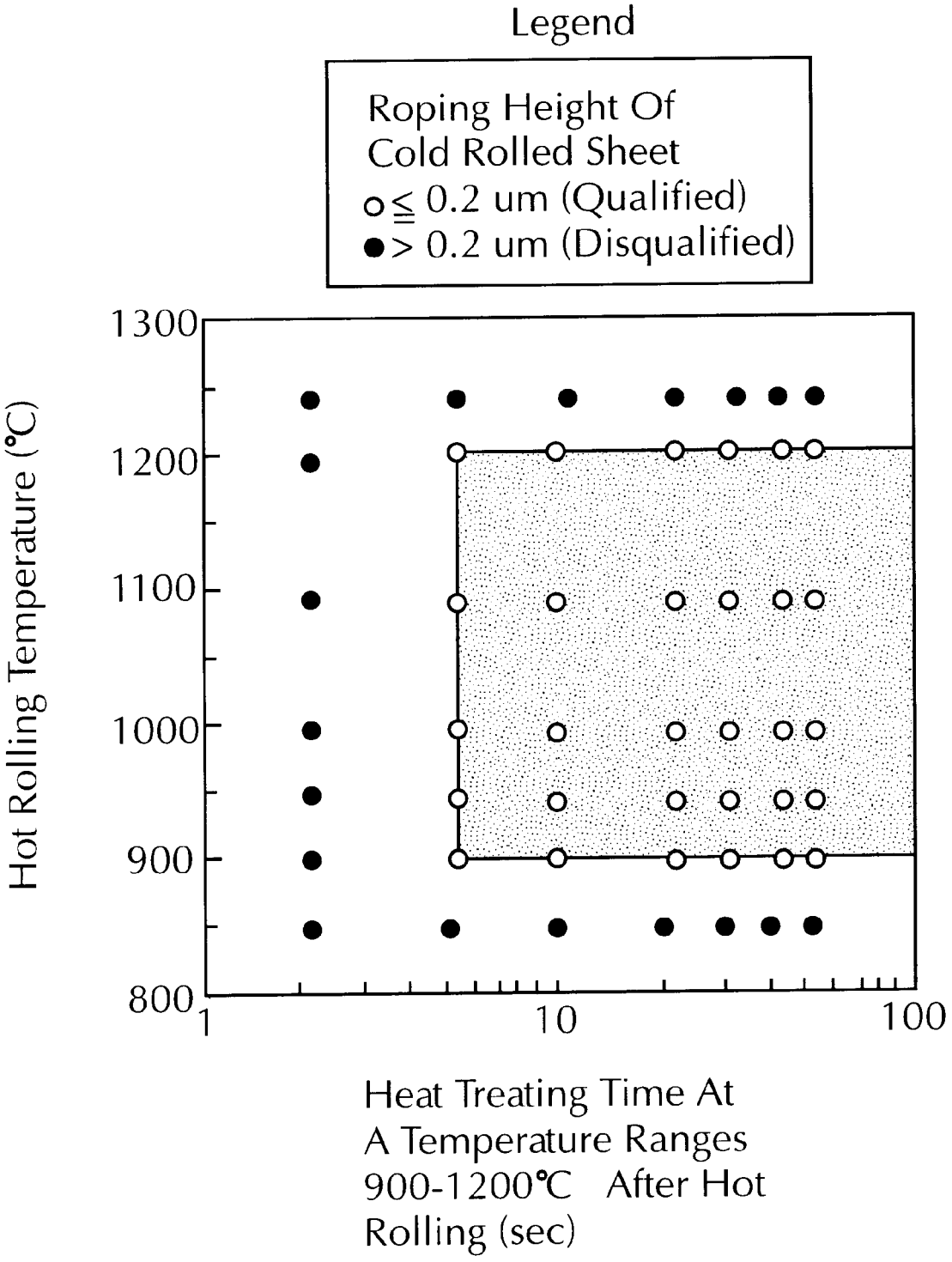
FIG. 2 is a graph showing the relationship between a heat-treatment temperature and time immediately after hot rolling versus a roping height on a cold-rolled product.

The heat-treating condition after hot rolling was determined by the following experiment. A type 304 steel was cast to a sheet thickness of 4 mm and hot rolling was carried out at a reduction ratio of 20% and at 1,100° C. Heat-treatment was then conducted at 1,250 to 900° C. by heating the sheet for 2 to 50 seconds by induction heating. After descaling, the slab was cold rolled at a reduction ratio of 50%, and roping on the surface of the resulting cold rolled sheet was evaluated. The result is shown in FIG. 2. When the heat-treatment temperature after hot rolling was higher than 1,200° C., the recrystallization grains became course, and when it was less than 900° C., recrystallization did not proceed, so that roping occurred. When the heat-treatment time was shorter than 5 seconds, a complete recrystallized structure could not be obtained, and roping consequently occurred. From the experimental result described above, the heat-treatment after hot rolling was set to a temperature within the range of 900 to 1,200° C. for the holding time of at least 5 seconds. A preferred range was within 1,050 to 1,150° C. and 10 to 30 seconds.

Thereafter, the cast strip was coiled at a temperature not higher than 600° C. When this condition was not satisfied, carbides precipitated in the grain boundary, grain boundary corrosion occurred when the material was pickled, and surface brightness of the product was lost. A preferred coiling temperature was not higher than 500° C.

EXAMPLE 1

A Cr—Ni type stainless steel comprising an 18% Cr–8% Ni steel as the basic component and shown in Table 1 was molten, and cast strip having various thickness between 2 and 10 mm were cast by an internal water cooling system vertical twin roll continuous casting machine. While the slab temperature was controlled by a jet type burner after casting, hot rolling was carried out at a temperature within the range of 850 to 1,250° C. The hot rolling reduction ratio was 5 to 50%. After hot rolling, the slab temperature was controlled by the jet type burner, and the heat-treatment was carried out at a temperature within the range of 850 to 1,250° C. for at least 2 seconds, and each cast strip was coiled at a temperature not higher than 600° C. Comparative Examples were those for which the hot rolling condition, the treatment condition after hot rolling and the coiling condition were outside the ranges of the present invention.

Thereafter, each material was pickled, descaled and cold rolled, and then each was subjected to ordinary annealing or bright annealing.

The surface properties of each of the resulting products were examined. Particularly, the roping height and luster of the product surface were examined. Because the hot rolling condition and the heat-treatment condition after hot rolling were optimized for the products of Examples of the invention, a 100% recrystallized structure having a grain size of not greater than 40 μm could be obtained as shown in Table 1 and, due also to the effect brought forth by the subsequent cooling rate control, each of the products exhibited excellent surface quality.

In the Comparative Examples, on the other hand, the hot rolling temperature, the reduction ratio and the heat-treatment after hot rolling were not sufficient, and the subsequent cooling control was not effected, either. Therefore, the roping was large and the surface brightness, too, was inferior.

As described above, the present invention makes it possible to produce a cold rolled steel sheet having excellent surface quality by controlling the hot rolling condition and the subsequent heat-treatment condition in the new process for the Cr—Ni type stainless steel. Therefore, the present invention provides great industrial effects.

TABLE 1-1

| | | | Cast strip | Hot rolling condition | | Heat-treating condition | | Cooling rate between 900 and 600° C. | Coiling temp. | Thin sheet production process | Surface quality | |
|---|---|---|---|---|---|---|---|---|---|---|---|---|
| | No. | Steel kind | thickness (mm) | Temp. (° C.) | Reduction ratio (%) | Temp. (° C.) | Time | (° C.) | (° C.) | | Roping (μm) | Brightness |
| Method of this invention | 1 | SUS304 | 3 | 1100 | 30 | 1100 | 10 | 50 | 600 | A | fair (0.07) | fair |
| | 2 | SUS305 | 3 | 1100 | 30 | 1100 | 10 | 50 | 600 | A | fair (0.09) | fair |
| | 3 | SUS310 | 3 | 1100 | 30 | 1100 | 10 | 50 | 600 | A | fair (0.08) | fair |
| | 4 | SUS316 | 3 | 1100 | 30 | 1100 | 10 | 50 | 600 | A | fair (0.07) | fair |
| | 5 | SUS308 | 3 | 1100 | 30 | 1100 | 10 | 50 | 600 | A | fair (0.07) | fair |
| | 6 | SUS309 | 3 | 1100 | 30 | 1100 | 10 | 50 | 600 | A | fair (0.07) | fair |
| | 7 | SUS304 | 3 | 1100 | 30 | 1100 | 10 | 50 | 600 | A | fair (0.07) | fair |
| | 8 | SUS304 | 10 | 1100 | 30 | 1100 | 10 | 50 | 600 | A | fair (0.08) | fair |
| | 9 | SUS304 | 3 | 900 | 30 | 1100 | 10 | 50 | 600 | A | fair (0.19) | fair |
| | 10 | SUS304 | 3 | 1000 | 30 | 1100 | 10 | 50 | 600 | A | fair (0.10) | fair |
| | 11 | SUS304 | 3 | 1200 | 30 | 1100 | 10 | 50 | 600 | A | fair (0.18) | fair |
| | 12 | SUS304 | 3 | 1100 | 10 | 1100 | 10 | 50 | 600 | A | fair (0.09) | fair |
| | 13 | SUS304 | 3 | 1100 | 20 | 1100 | 10 | 50 | 600 | A | fair (0.10) | fair |
| | 14 | SUS304 | 3 | 1100 | 50 | 1100 | 10 | 50 | 600 | A | fair (0.08) | fair |
| | 15 | SUS304 | 3 | 1100 | 30 | 900 | 10 | 50 | 600 | A | fair (0.18) | fair |
| | 16 | SUS304 | 3 | 1100 | 30 | 1000 | 10 | 50 | 600 | A | fair (0.07) | fair |
| | 17 | SUS304 | 3 | 1100 | 30 | 1200 | 10 | 50 | 600 | A | fair (0.17) | fair |
| | 18 | SUS304 | 3 | 1100 | 30 | 1100 | 5 | 50 | 600 | A | fair (0.10) | fair |
| | 19 | SUS304 | 3 | 1100 | 30 | 1100 | 20 | 50 | 600 | A | fair (0.09) | fair |
| | 20 | SUS304 | 3 | 1100 | 30 | 1100 | 10 | 20 | 600 | A | fair (0.09) | fair |
| | 21 | SUS304 | 3 | 1100 | 30 | 1100 | 10 | 200 | 600 | A | fair (0.09) | fair |
| | 22 | SUS304 | 3 | 1100 | 30 | 1100 | 10 | 50 | 400 | A | fair (0.09) | fair |
| | 23 | SUS304 | 3 | 1100 | 30 | 1100 | 10 | 50 | 500 | A | fair (0.10) | fair |
| | 24 | SUS304 | 3 | 1100 | 30 | 1100 | 10 | 50 | 600 | B | fair (0.08) | fair |

Remarks 1:
In the process A, strip was descaled, cold rolled.

TABLE 1-2

| | No. | Steel kind | Cast strip thickness (mm) | Hot rolling condition Temp. (° C.) | Hot rolling condition Reduction ratio (%) | Heat-treating condition Temp. (° C.) | Heat-treating condition Time | Cooling rate between 900 and 600° C. (° C.) | Coiling temp. (° C.) | Thin sheet production process | Surface quality Roping (μm) | Surface quality Brightness |
|---|---|---|---|---|---|---|---|---|---|---|---|---|
| Comparative Method | 25 | SUS304 | 12 | 1100 | 30 | 1100 | 10 | 50 | 600 | A | inferior (0.35) | fair |
| | 26 | SUS304 | 3 | 850 | 30 | 1100 | 10 | 50 | 600 | A | inferior (0.42) | fair |
| | 27 | SUS304 | 3 | 1250 | 30 | 1100 | 10 | 50 | 600 | A | inferior (0.36) | fair |
| | 28 | SUS304 | 3 | 1100 | 5 | 1100 | 10 | 50 | 600 | A | inferior (0.25) | fair |
| | 29 | SUS304 | 3 | 1100 | 30 | 850 | 10 | 50 | 600 | A | inferior (0.45) | fair |
| | 30 | SUS304 | 3 | 1100 | 30 | 1250 | 10 | 50 | 600 | A | inferior (0.42) | inferior (Scratch) |
| | 31 | SUS304 | 3 | 1100 | 30 | 1100 | 2 | 50 | 600 | A | inferior (0.56) | fair |
| | 32 | SUS304 | 3 | 1100 | 30 | 1100 | 10 | 10 | 600 | A | (fair) (0.10) | inferior (Micro-groove) |
| | 33 | SUS304 | 3 | 1100 | 30 | 1100 | 10 | 50 | 700 | A | fair (0.10) | inferior (Micro-groove) |

Remarks 1:
In the process A, cast strip was descaled, cold rolled, annealed and pickled to obtain a thin sheet product.
In the process B, cast strip was descaled, cold rolled, annealed, pickled and skin pass rolled to obtain a thin sheet product.

What is claimed is:

1. A method for producing a Cr—Ni stainless steel thin sheet having excellent surface quality in an in-line production process, comprising the steps of:

continuously casting a molten steel of Cr—Ni stainless steel to a cast strip having a sheet thickness not greater than 10 mm by a continuous casting machine having a casting mold wall surface which moves in synchronism with the cast strip;

subsequently hot rolling said cast strip immediately after casting at a temperature within the range of 1,000 to 1,150° C. and a reduction ratio of 10 to 50%;

carrying out heat treatment of the hot rolled strip immediately after the hot rolling by holding the hot rolled strip at a temperature within the range of 1,050° C. to 1,150° C. for at least 5 seconds for obtaining a complete recrystallization structure, without interruption of production flow;

subsequently coiling said heat treated strip at temperature not higher than 600° C.

2. A method for producing a Cr—Ni stainless steel thin sheet in an in-line production process comprising the steps of:

continuously casting a molten Cr—Ni stainless steel to a cast strip having a sheet thickness not greater than 10 mm;

hot rolling the cast strip immediately after casting at a temperature within the range of 900 to 1200° C. with a reduction ratio of 10 to 50%;

heat treating the hot rolled strip immediately after the hot rolling by maintaining the hot rolled strip at a temperature within the range of 900 to 1200° C. for a least 5 seconds for obtaining a complete recrystallized structure, without stop or interruption of production flow;

subsequently coiling the heat treated strip.

3. A production method of a Cr—Ni stainless steel thin sheet according to claim 2, further comprising carrying out cooling at a cooling rate of at least 20° C./sec at a temperature within the range of 900 to 600° C. in succession to said heat-treatment step of claim 2.

4. A method for producing a Cr—Ni stainless steel thin sheet in an in-line production process comprising the steps of:

continuously casting a molten Cr—Ni stainless steel to a cast strip having a sheet thickness not greater than 10 mm by a continuous casting machine having a casting mold wall surface which moves in synchronism with the cast strip;

hot rolling the cast strip immediately after casting at a temperature within the range of 900 to 1200° C. with a reduction ratio of 10 to 50%;

heat treating the hot rolled strip immediately after the hot rolling by maintaining the hot rolled strip at a temperature within the range of 900 to 1200° C. for a least 5 seconds for obtaining a complete recrystallized structure, without stop or interruption or production flow;

subsequently coiling the heat treated strip at a temperature not higher than 600° C.

5. A method for producing a Cr—Ni stainless steel thin sheet, comprising carrying out skin pass rolling in succession to said method according to claim 2 or 4.

* * * * *

UNITED STATES PATENT AND TRADEMARK OFFICE

CERTIFICATE OF CORRECTION

PATENT NO. : 6,099,665
DATED : August 8, 2000
INVENTOR(S) : Shin-ichi Teraoka, et al.

It is certified that error appears in the above-identified patent and that said Letters Patent is hereby corrected as shown below:

Column 8, line 53, change "or" before "production" to -of-.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*